US006996363B2

(12) United States Patent
Aoki et al.

(10) Patent No.: US 6,996,363 B2
(45) Date of Patent: Feb. 7, 2006

(54) HEATING ROLLER OF A FIXING DEVICE WITH TWO INTERNAL HEATERS FOR AXIAL HEAT DISTRIBUTION

(75) Inventors: Kohji Aoki, Nara (JP); Kohichi Moriyama, Ikoma (JP); Motoaki Okitsu, Nara (JP); Hiroaki Hori, Kyoto (JP); Tatsuya Shinkawa, Nara (JP); Hideki Goto, Matsumoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/885,669

(22) Filed: Jul. 8, 2004

(65) Prior Publication Data

US 2005/0008414 A1 Jan. 13, 2005

(30) Foreign Application Priority Data

Jul. 9, 2003 (JP) ..... 2003-272313

(51) Int. Cl.
*G03G 15/20* (2006.01)

(52) U.S. Cl. ..... 399/334; 219/216; 399/330; 399/335

(58) Field of Classification Search ..... 399/330, 399/334, 335; 219/216
See application file for complete search history.

(56) References Cited

U.S. PATENT DOCUMENTS

| | | | | |
|---|---|---|---|---|
| 4,580,033 | A * | 4/1986 | Sakurai | 219/216 |
| 5,512,993 | A | 4/1996 | Endo et al. | |
| 6,385,410 | B1 * | 5/2002 | Hanyu et al. | 399/68 |
| 2003/0190170 | A1 * | 10/2003 | Hamada et al. | 399/69 |

FOREIGN PATENT DOCUMENTS

| | | | |
|---|---|---|---|
| JP | H04-337783 | A | 11/1992 |
| JP | H06-011998 | A | 1/1994 |
| JP | H08-123230 | A | 5/1996 |
| JP | 2001-175120 | A | 6/2001 |
| JP | 2001154521 | A * | 6/2001 |
| JP | 2001343859 | A * | 12/2001 |

* cited by examiner

*Primary Examiner*—Arthur T. Grimley
*Assistant Examiner*—Peter Lee
(74) *Attorney, Agent, or Firm*—Birch, Stewart, Kolasch & Birch, LLP

(57) ABSTRACT

A heating device for heating a recording sheet. The heating device has a first heater located within a heating roller. The first heater has a heat distribution effective to form a low temperature region in an axially central portion of the heating roller and a high temperature region in each of axially opposite end portions of the heating roller. There is a second heater located within the heating roller that has a heat distribution effective to form a high temperature region in the axially central portion of the heating roller, a low temperature region in each of the opposite end portions of the heating roller, and a second-level high temperature region in each of axially opposite end portions of the high temperature region, the second-level high temperature region being lower in temperature than the high temperature region.

10 Claims, 6 Drawing Sheets

HEATING ROLLER OF A FIXING DEVICE WITH TWO INTERNAL HEATERS FOR AXIAL HEAT DISTRIBUTION

CROSS REFERENCE

This Nonprovisional application claims priority under 35 U.S.C. §119(a) on Patent Application No. 2003-272313 filed in Japan on Jul. 9, 2003, the entire contents of which are hereby incorporated by reference.

BACKGROUND OF THE INVENTION

The present invention relates to a heating device for heating a recording sheet being transported on a sheet feed path.

In heating a recording sheet with a heating roller, the temperature of the heater provided within the heating roller is established so that the surface temperature of the heating roller falls within a predetermined allowable range. When the heating roller is used in a fixing device for example, the temperature of the heater provided in the heating roller is established so that the surface temperature of the heating roller falls within a range between the upper limit and the lower limit of the fixing temperature.

However, the surface temperature of the heating roller is influenced by the frequency of contacts with recording sheets. A portion of the heating roller surface which frequently contacts recording sheets is subject to cooling due to transfer of heat to recording sheets. In contrast, a portion of the heating roller surface which does not contact recording sheets very frequently is not cooled readily. In heating small-sized recording sheets successively for example, axially opposite end portions of the heating roller do not contact the recording sheets and hence are not cooled readily. For this reason, the surface temperature of the opposite end portions of the heating roller sometimes becomes higher than necessary in heating such small-sized recording sheets successively even when the established temperature of the heater disposed within the heating roller is proper. In the case where the heating roller is used in the fixing device, such an inconvenience that a recording sheet or fused toner twines around the heating roller is likely to occur when the surface temperature of the heating roller becomes higher than the upper limit of fixing temperature.

In attempt to solve this problem, one prior-art heating device is designed to set the surface temperature of a heating roller using two heaters, as in the invention described in Japanese Laid-Open Patent Application No. 2001-175120.

FIGS. 1A and 1B show the heat distribution characteristics of heaters used in a conventional heating device and the surface temperature of a heating roller used in the conventional heating device. In FIG. 1A, the abscissa represents locations along the axis of the heating roller while the ordinate represents surface temperatures of the heating roller. "Max", "Min" and "F" in FIG. 1A represent the upper limit, lower limit and established value, respectively, of fixing temperature. In FIG. 1B, the abscissa represents locations along the axis of the heating roller while the ordinate represents the heat distribution characteristic of each heater. The heating device of FIGS. 1A and 1B includes a main heater and a sub-heater. As plotted by line X1 in FIG. 1B, the main heater has such a heat distribution characteristic as to provide a high temperature in an axially central portion of the heating roller and a low temperature in axially opposite end portions of the heating roller. As plotted by line X2 in the same figure, the sub-heater has such a heat distribution characteristic as to provide a low temperature in the axially central portion of the heating roller and a high temperature in the axially opposite end portions of the heating roller.

Such an arrangement performs temperature control over the heating roller in accordance with recording sheet sizes. For example, only the main heater is actuated when heating is to be performed on a recording sheet having a width smaller than L2 axially of the heating roller. Such conventional temperature control can prevent the surface temperature of the axially opposite end portions of the heating roller from becoming higher than necessary even when small-sized recording sheets are heated successively.

In these years, however, frequent use is made of recording sheets of very small sizes (hereinafter will be referred to as "very small-sized recording sheet(s)"), such as postcards, which are much smaller than the aforementioned small-sized recording sheets, giving rise to a new problem. In FIG. 1A, "L1" represents the width of a very small-sized recording sheet which extends parallel with the axis of the heating roller.

In successive heating of very small-sized recording sheets, a portion of the surface of the heating roller which is heated by the main heater but does not contact the very small-sized recording sheets is heated to a temperature higher than necessary even under the aforementioned temperature control, as the case may be.

In FIG. 1A, curve T1 plots the surface temperature of the heating roller before heating of recording sheets and curve T2 plots the surface temperature of the heating roller after successive heating of very small-sized recording sheets. As can be seen from FIG. 1A, the surface temperature of a portion of the heating roller becomes higher than the upper limit of fixing temperature after successive heating of the very small-sized recording sheets.

According to the prior art, an additional heater dedicated to heating of very small-sized recording sheets need be provided within the heating roller in order to maintain the surface temperature of the heating roller within a proper range even in successive heating of very small-sized recording sheets. This results in an inconvenience that the cost is increased by the provision of such an additional heater. Further, heating rollers of some sizes do not allow three or more heaters to be accommodated within each of them for the reason of space.

SUMMARY OF THE INVENTION

A feature of the present invention is to provide a heating device capable of properly heating recording sheets of all sizes from a very small size to a large size with use of two heaters.

A heating device according to the present invention includes a heating roller accommodating first and second heaters therein. The first heater has a heat distribution characteristic such as to form a low temperature region in an axially central portion of the heating roller and a high temperature region in each of axially opposite end portions of the heating roller. The second heater has a heat distribution characteristic such as to form a high temperature region in the axially central portion of the heating roller, a second-level high temperature region on each of opposite sides of the high temperature region, the second-level high temperature region being lower in temperature than the high temperature region, and a low temperature region in each of the opposite end portions of the heating roller.

The first heater is used in heating a large-sized recording sheet. The second heater is used in heating a small-sized recording sheet and a very small-sized recording sheet. Since the second-level high temperature region formed by the second heater occupies each of opposite end portions of the high temperature region, a portion of the heating roller which does not contact very small-sized recording sheets is not readily heated to an elevated temperature.

The foregoing and other objects, features and attendant advantages of the present invention will become more apparent from the reading of the following detailed description of the invention in conjunction with the accompanying drawings.

DETAILED DESCRIPTION OF THE PREFERRED EMBODIMENTS

Hereinafter, a digital copying machine incorporating a heating device as an embodiment of the present invention will be described in detail with reference to the accompanying drawings.

Figures 1A, 1B:
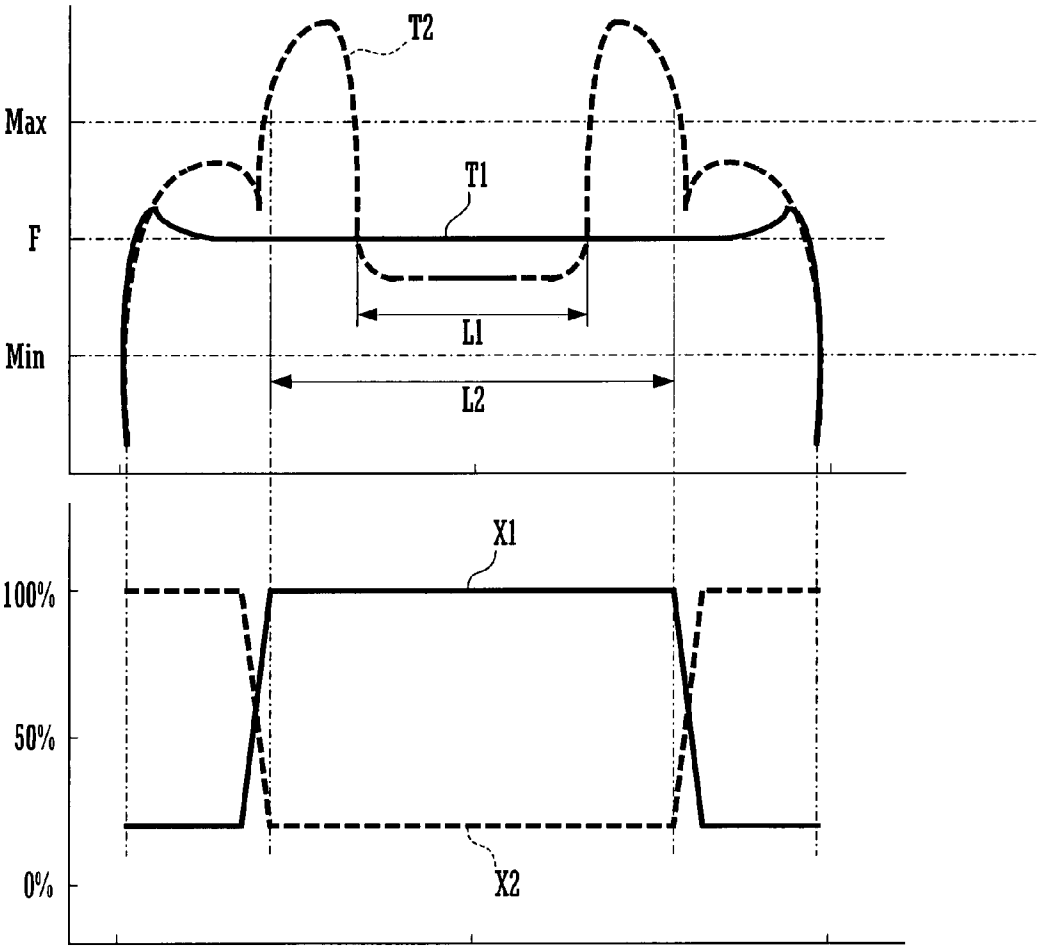
FIG. 1B PRIOR ART
FIGS. 1A and 1B are each a chart showing a heat distribution characteristic of a conventional fixing device.
Figure 2:
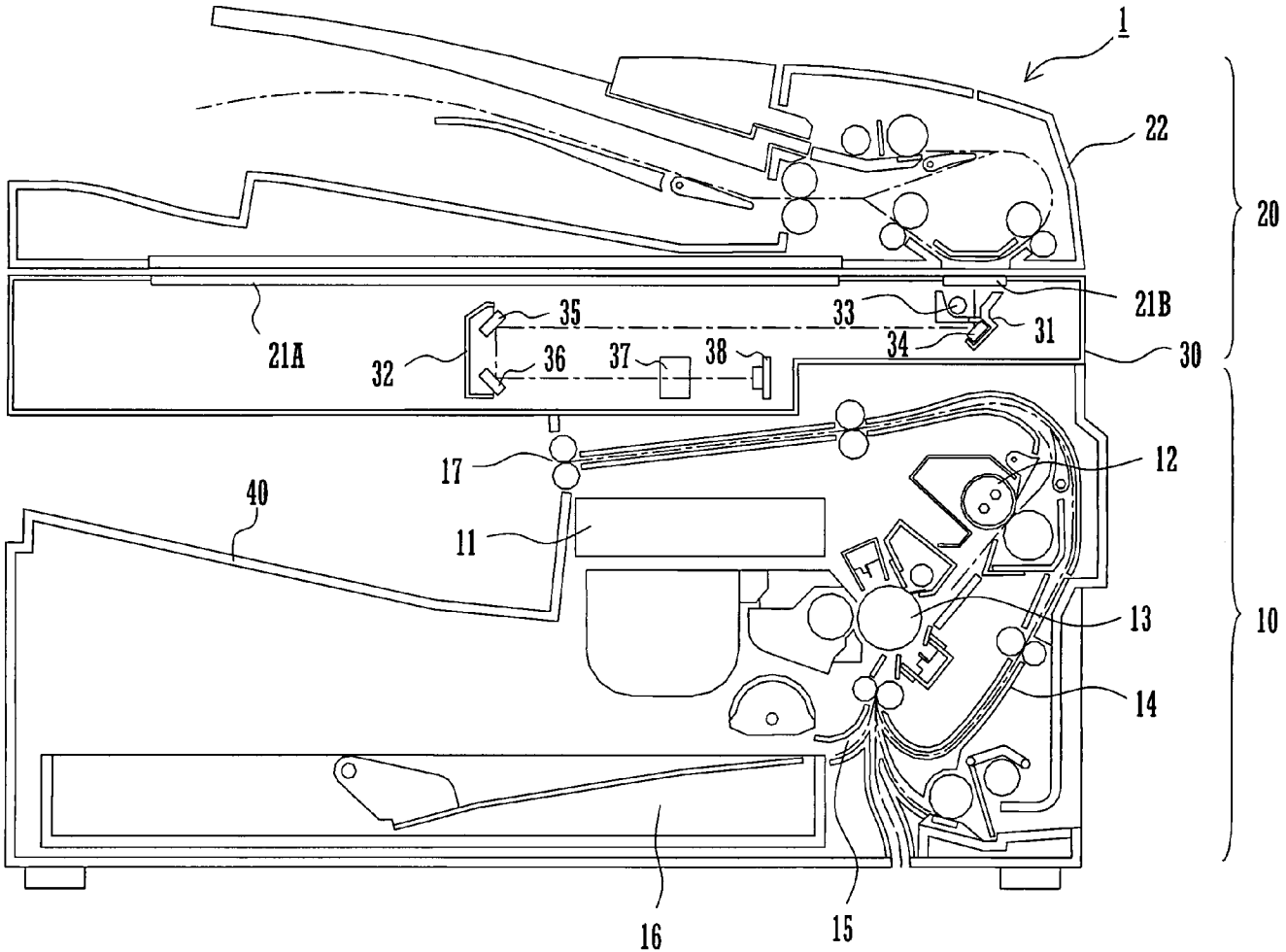
FIG. 2 is a view showing the construction of a digital copying machine according to an embodiment of the present invention.

FIG. 2 is a view showing the construction of digital copying machine 1. As shown, the digital copying machine 1 includes a document reading section 20 and an image forming section 10.

The document reading section 20 includes platens 21A and 21B, a scanner unit 30, and a reversible automatic document feeder (hereinafter will be referred to as "RADF") 22. The platens 21A and 21B each include transparent glass. The platen 21A is used for document reading in a stationary document mode, while the platen 21B used for document reading in a document feed mode using RADF 22.

The RADF 22 feeds a document onto the platen 21B automatically. The RADF 22 has a document tray not shown and feeds plural document sheets set on the document tray onto the platen 21B one by one automatically. To allow the scanner unit 30 to read the image of each document sheet on one side or both sides thereof, the RADF 22 further includes a feed path for feeding one-sided document sheets, a feed path for feeding double-sided document sheets, feed path switching means, and plural sensors for checking and controlling the condition of each document sheet passing by predetermined points.

The scanner unit 30 reads image information from a document placed on platen 21A or 21B. The scanner unit 30 includes a first scanning unit 31, a second scanning unit 32, an optical lens 37, and a charge-coupled device (hereinafter will be referred to as "CCD") 38.

The first scanning unit 31 is equipped with a lamp reflector assembly 33 for exposing the surface of each document sheet to light, and a first reflecting mirror 34 for reflecting a reflected light image from each document sheet to guide it to the second scanning unit 32. The second scanning unit 32 is equipped with second and third reflecting mirrors 35 and 36 for guiding the reflected light image guided from the first scanning unit 31 to the CCD 38. The optical lens 37 focuses the reflected light image from the document sheet onto the CCD 38. The CCD 38 converts the reflected light image from the document sheet into electric image signals.

In the document reading section 20, the image information on the document placed on the platen 21A or 21B is read by imaging the image information line by line on the CCD 38. The image information read by the scanner unit 30 is transmitted as image data to an image processing section not shown. The image data is subjected to a variety of image processing in the image processing section and then transferred to the image forming section 10.

The image forming section 10 includes a sheet feed cassette.16, a transport section 15, a laser writing unit 11, an electrophotographic processing section 13, a re-feed path 14, a fixing device 12, and sheet ejecting rollers 17.

The sheet feed cassette 16 accommodates recording sheets to be subjected to the image forming process. A sheet feed (transport) path is formed to extend from the sheet feed cassette 16 to the sheet ejecting rollers 17 via the electrophotographic processing section 13. The transport section 15 includes plural transport rollers located along the sheet feed path for transporting a recording sheet on the sheet feed path toward the downstream side in the sheet feed direction.

The electrophotographic processing section 13 includes a photosensitive drum, a static charger, a developing device, a transfer device, a peeler, a cleaner, and a static eliminator. The photosensitive drum is an image carrier for carrying an image thereon. The static charger electrostatically charges the photosensitive drum uniformly. The developing device supplies a developer onto an electrostatic latent image which is formed on the photosensitive drum by the laser writing unit 11. The transfer device transfers the developer image (toner image) on the photosensitive drum to a recording sheet. The peeler peels the recording sheet off the photosensitive drum. The cleaner removes residual developer remaining on the photosensitive drum. The static eliminator eliminates static charge from the surface of the photosensitive drum.

The fixing device 12 is located downstream of the electrophotographic processing section 13 in the sheet feed direction. The fixing device 12 fixes the developer image adhering to the recording sheet in an unfixed condition to the recording sheet by utilizing heat and pressure. A branch to the re-feed path 14 is formed between the fixing device 12 and the ejecting rollers 17. The re-feed path 14 is used to feed the recording sheet bearing the fixed image on the obverse side thereof to the electrophotographic processing section 13 again for the purpose of forming an image on the reverse side of the recording sheet.

Figure 3:
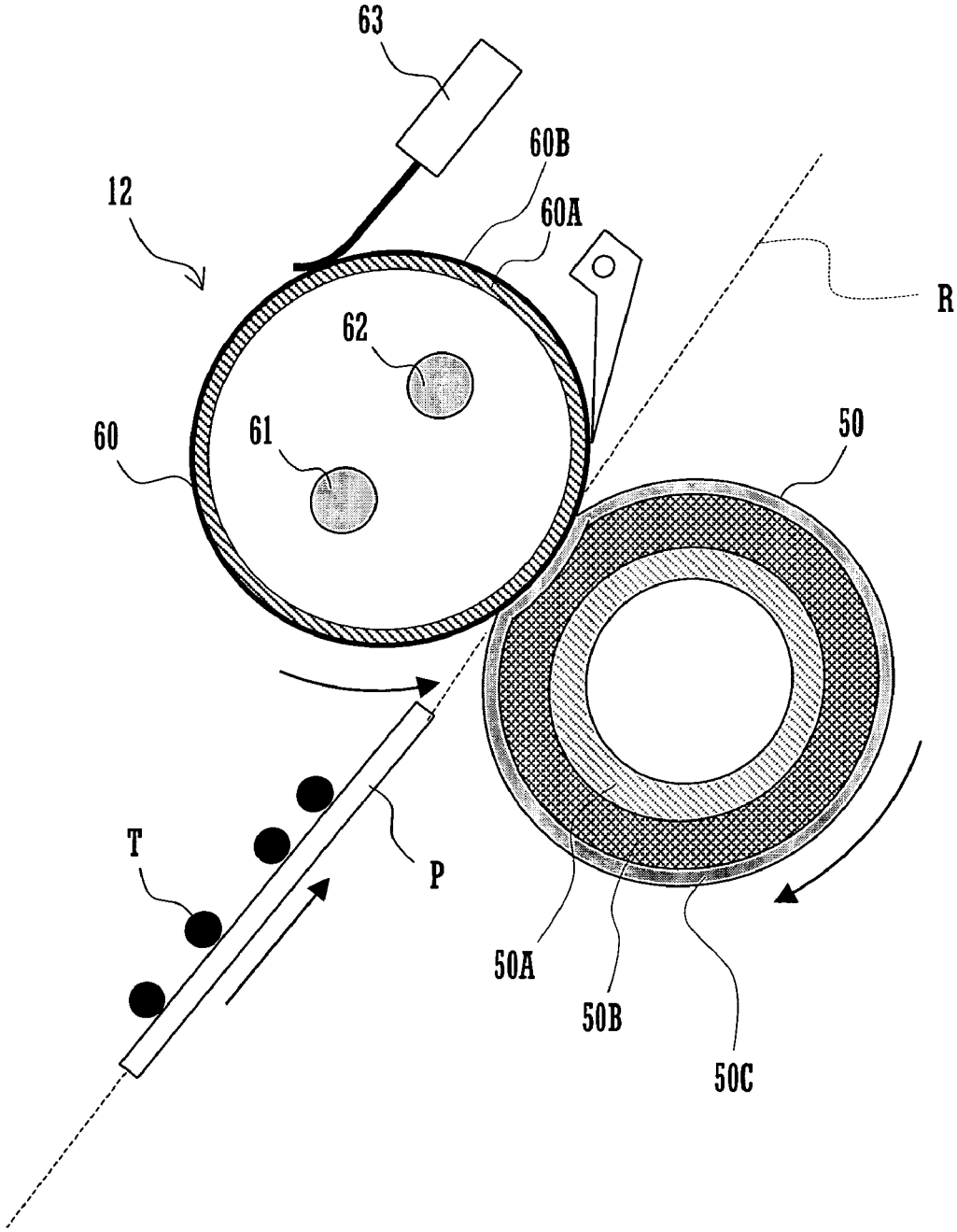
FIG. 3 is a view showing the arrangement of a fixing device according to an embodiment of the present invention.

FIG. 3 shows the arrangement of the fixing device 12. The fixing device 12 includes a heating roller 60, a pressure roller 50, and a temperature sensor 63. The heating roller 60 and the pressure roller 50 are positioned to press against each other across sheet feed path R.

The pressure roller 50 has a core 50A of stainless steel. A heat-resistant resilient material layer 50B of silicone rubber is formed over the outer periphery of the core 50A. A release layer 50C of a fluoroplastic is formed over the outer periphery of the heat-resistant resilient material layer 50B. Instead of stainless steel, use may be made of steel, aluminum or the like as the material of the core 50A.

The heating roller 60 has a core 60A and a release layer 60B. The core 60A is formed of stainless steel and has a thickness of about 0.1 to about 0.5 mm. The core 60A may be formed of such a metal as iron, aluminum or copper, or an alloy thereof. Within the core 60A are disposed a heater lamp 62 adapted to a large-sized recording sheet and a heater lamp 61 adapted to a small-sized recording sheet. In this embodiment, the heater lamp 62 and the heater lamp 61 constitute the first heater and the second heater, respectively, of the present invention. The release layer 60B is formed over the outer periphery of the core 60A. The release layer 60B prevents toner T from exfoliating from recording sheet P and adhering to the surface of the heating roller 60.

The temperature sensor 63 detects the surface temperature of the heating roller 60. The temperature sensor 63 is disposed in opposed relation to the axially central portion of the heating roller 60. The temperature sensor 63 thus disposed detects the temperature of the highest-temperature portion of the heating roller 60.

Figure 4:
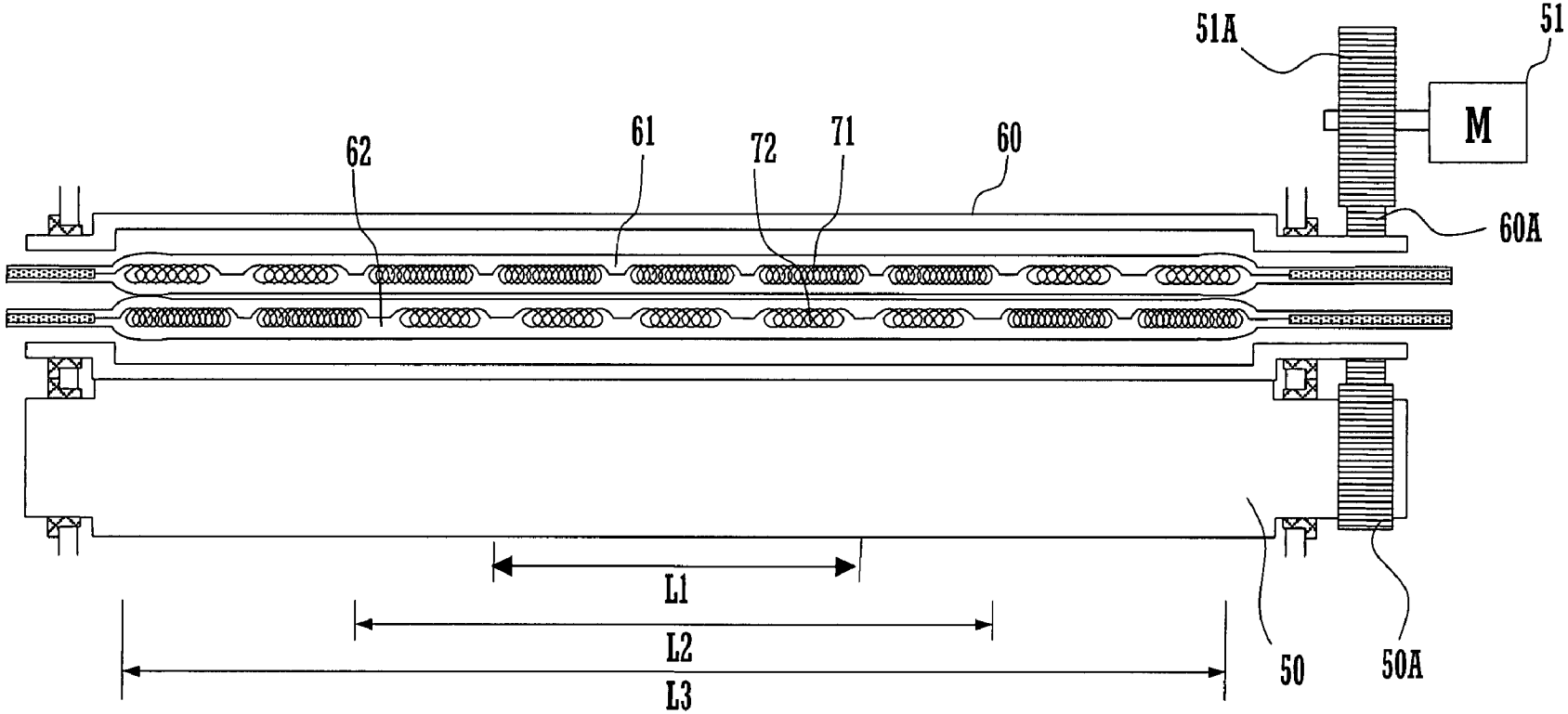
FIG. 4 is a view showing the internal structure of a heating roller.

FIG. 4 shows the internal structure of the heating roller 60. Within the heating roller 60 are disposed the heater lamps 61 and 62 extending along the axis of the heating roller 60 intersecting the sheet feed path R perpendicularly thereto. The heater lamp 61 internally has a heater wire 71 forming plural coils each having a predetermined winding pitch and the heater lamp 62 internally has a heater wire 72 forming plural coils each having a predetermined winding pitch.

The heating roller 60 has a rotating shaft fitted with a gear 60A, which in turn meshes with a gear 51A fitted on the rotating shaft of a driving motor 51. The gear 60A meshes also with a gear 50A fitted on the rotating shaft of the pressure roller 50. In this embodiment the driving motor 51 constitutes a driving source for driving the pressure roller 50 and the heating roller 60.

The heater lamp 61 defines, from its center toward its opposite ends, a high temperature region in which each coil has the largest number of turns, second-level high temperature regions in each of which each coil has a number of turns in the range from 80% to 90% as large as the number of turns of coil in the high temperature region, and low temperature regions in each of which each coil has a number of turns in the range from 10% to 40% as large as the number of turns of coil in the high temperature region.

In contrast, the heater lamp 62 defines a low temperature region in its central portion and high temperature regions in its opposite end portions. In the low temperature region each coil has a number of turns in the range from 10% to 40% as large as the number of turns of coil in each of the high temperature regions. Each coil has some number of turns even in each low temperature region for the purpose of preventing the occurrence of a break in each of the heater wires 71 and 72 forming coils.

The thermal output of the second-level high temperature region is set to fall within the range from 80% to 90% as high as that of the high temperature region because if a steep change in thermal output is provided between the high temperature region and the second-level high temperature region then a break is likely to occur in each of the heater wire 71. Since the temperature of the second-level high temperature region is set to fall within the range from 80% to 90% as high as that of the high temperature region, even the second-level high temperature region can supply a sufficient amount of heat to the surface of the heating roller 60. For this reason, even when the high temperature region of the heater lamp 61 is partially replaced with the second-level high temperature region, a fixing failure is unlikely in heating of a large-sized recording sheet.

In this embodiment, the heat distribution characteristic of each of the heater lamps 61 and 62 is adjusted by adjusting the number of turns of each coil and the heater wires 71 and 72 each have a constant thickness throughout all the regions of each of the heater lamps 61 and 62. With this arrangement, a break is less likely to occur in each of the heater wires 71 and 72 than in the case where the heat distribution characteristic of each of the heater lamps 61 and 62 is adjusted by varying the thickness of each heater wire 71 or 72. Accordingly, each of the heater lamps 61 and 62 can enjoy a longer life. Further, the use of the heater wires 71 and 72 each having a constant thickness can make the heater lamps 61 and 62 hard to break by shock.

The width of the high temperature region in the heater lamp 61 is established based on the minimum of the sizes of recording sheets that can pass through the digital copying machine 1 properly. Since the minimum of the sizes of recording sheets that can pass through the digital copying machine 1 is a postcard size in this embodiment, the width of the high temperature region in the heater lamp 61 is established so as to be substantially equal to width L1 of a postcard on the shorter side shown in FIG. 4.

The high temperature region and the second-level high temperature regions constitute a relatively high temperature region in the heater lamp 61. In this embodiment the width of relatively high temperature region is established so as to be substantially equal to width L2 of a B5-size recording sheet in portrait orientation. The aforementioned widths of respective of the high temperature region and the relatively high temperature region are only illustrative and can be established otherwise.

Figure 5:
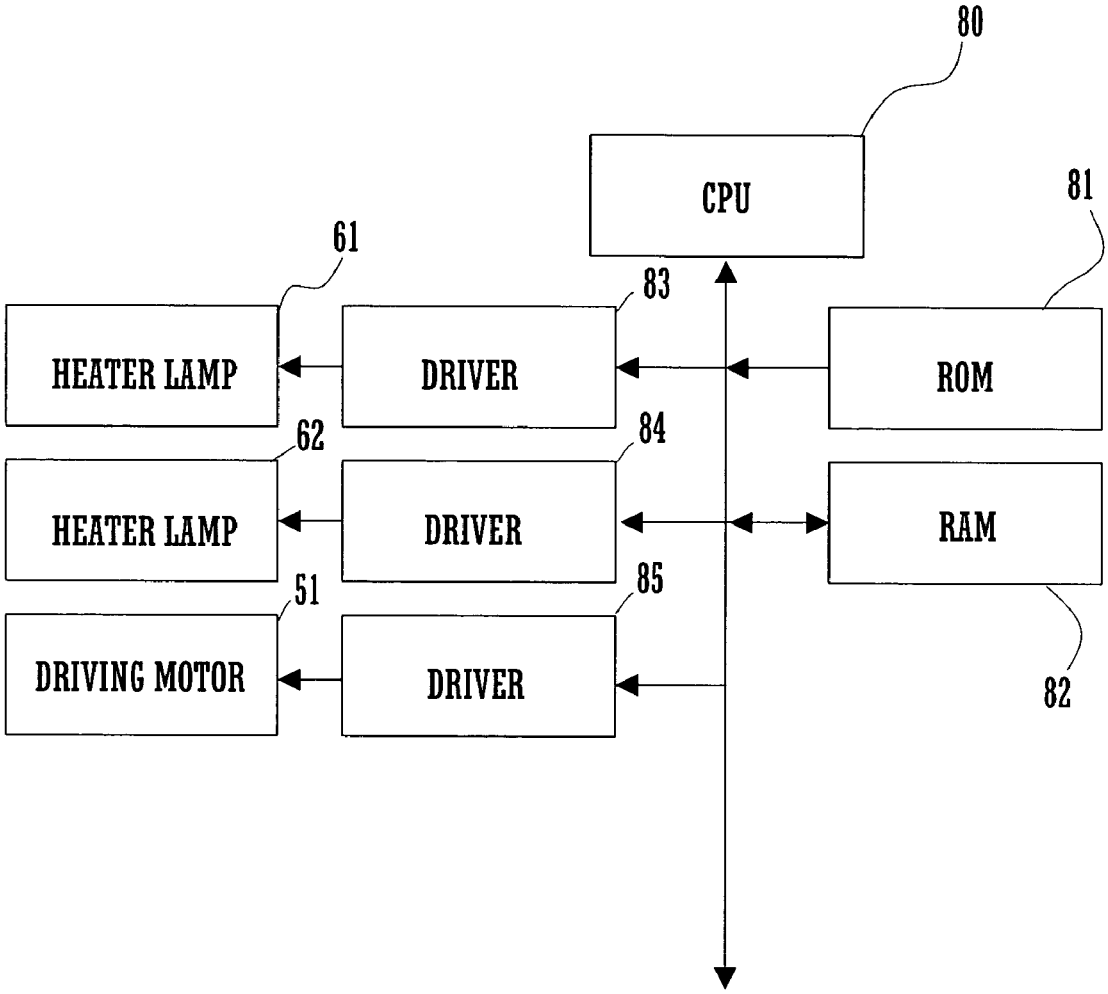
FIG. 5 is a block diagram showing the configuration of a part of a control section of the digital copying machine.

FIG. 5 shows the configuration of a part of the control section of the digital copying machine 1. The part of the control section shown is related to the operation of the fixing device. As shown in FIG. 5, the control section of the digital copying machine 1 includes a CPU 80, ROM 81, RAM 82, and drivers 83 to 85. Programs required to operate the digital copying machine 1 are stored in the ROM 81. The CPU 80 reads the programs stored in the ROM 81 and causes each part of the digital copying machine 1 to operate according to the programs thus read. The RAM 82 is volatile memory for retaining data temporarily.

The driver 83 actuates the heater lamp 61 by feeding electric power thereto in response to an output signal from the CPU 8b. The driver 84 actuates the heater lamp 62 by feeding electric power thereto in response to an output signal from the CPU 80. The driver 85 actuates the driving motor 51 by feeding electric power thereto in response to an output signal from the CPU 80. In this embodiment the heater lamp 61 is fed with an electric power of 600W and the heater lamp 62 fed with an electric power of 200W.

In the digital copying machine 1, a sensor not shown detects the size of a recording sheet being transported on the sheet feed path and detected data is transmitted to the CPU 80. When the width of the recording sheet being transported on the sheet feed path is not more than a predetermined value, the CPU 80 actuates the heater lamp 61 only. On the other hand, when the width is more than the predetermined value, the CPU 80 actuates the heater lamps 61 and 62 both. Specifically, only the heater lamp 61 is actuated when copying is to be made on a recording sheet of A4R-size, B5-size or postcard-size. When copying is to be made on a recording sheet of a larger size, both of the heater lamps 61 and 62 are actuated.

Figures 6A, 6B:
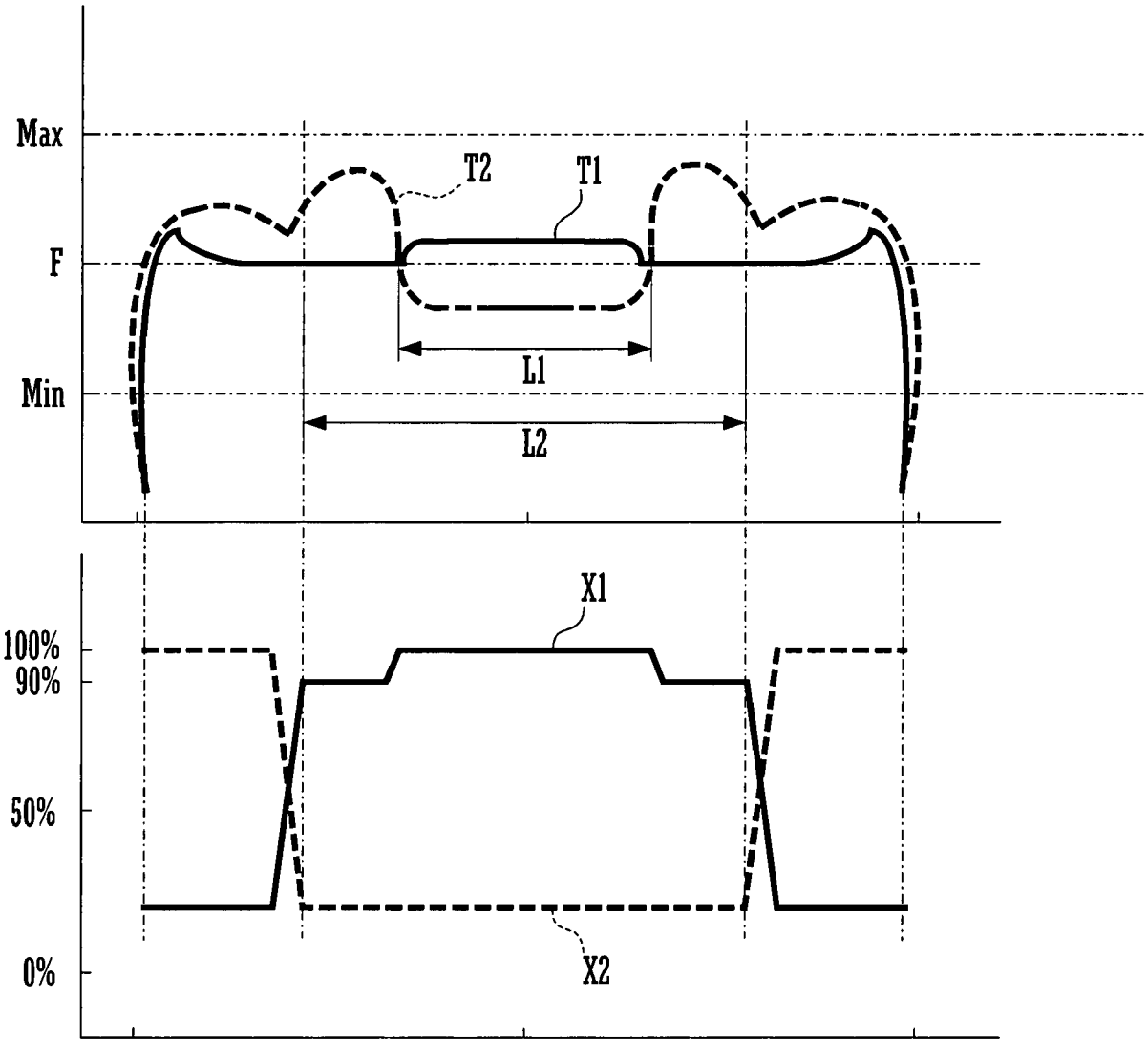
FIGS. 6A and 6B are each a chart showing a heat distribution characteristic of a fixing device according to the present invention.

FIG. 6A plots the surface temperature of the heating roller 60, while FIG. 6B plots the heat distribution characteristic of each of the heater lamps 61 and 62. In each of FIGS. 6A and 6B, the abscissa represents locations along the axis of the heating roller 60.

Since the heater wire 71 of the heater lamp 61 is wound with the largest number of turns in the high temperature region extending from the axial center toward the opposite ends, with the second largest number of turns in the second-level high temperature regions, and with the smallest number of turns in the low temperature regions, the heat distribution characteristic of the heater lamp 61 is as plotted by line X1 in FIG. 6B. On the other hand, since the heater wire 72 of the heater lamp 62 is wound closely in the axially opposite end portions and loosely in the axially central portion, the heat distribution characteristic of the heater lamp 62 is as plotted by line X2 in FIG. 6B.

In FIG. 6A, curve T1 plots the surface temperature of the heating roller 60 on standby for printing while curve T2 plots the surface temperature of the heating roller 60 heating very small-sized recording sheets, such as postcards, successively. According to this embodiment, even when the heating roller 60 heats very small-sized recording sheets successively, the surface temperature of the heating roller 60 can fall within the range between the upper limit and the lower limit of fixing temperature throughout all the regions defined along the axis of the heating roller 60.

According to this embodiment, in passing very small-sized recording sheets, such as postcards or business cards, successively through the fixing device, the portion of the heating roller which does not contact the very small-sized recording sheets is heated by the second-level high temperature regions of the heater lamp 61 and, hence, the temperature of that portion is unlikely to become higher than necessary.

Since this embodiment is capable of establishing three levels of heating temperature without using three heaters, the surface temperature of the heating roller can be properly adjusted with a simple arrangement. Though this embodiment employs coils with three different numbers of turns, coils with not less than four different numbers of turns may be employed.

The foregoing embodiment is illustrative in all points and should not be construed to limit the present invention. The scope of the present invention is defined not by the foregoing embodiment but by the following claims. Further, the scope of the present invention is intended to include all modifications within the meanings and scopes of claims and equivalents.

What is claimed is:

1. A heating device for heating a recording sheet being transported on a sheet feed path through a heating roller, comprising:

a first heater disposed within the heating roller and having a heat distribution characteristic to form a low temperature region in an axially central portion of the heating roller and a high temperature region in each of axially opposite end portions of the heating roller; and a second heater disposed within the heating roller and having a heat distribution effective to form a high temperature region in the axially central portion of the heating roller, a low temperature region in each of the opposite end portions of the heating roller, and a second-level high temperature region in each of axially opposite end portions of the high temperature region, the second-level high temperature region being lower in temperature than the high temperature region.

2. The heating device according to claim 1, wherein the high temperature region formed by the second heater has a width substantially equal to a width of a recording sheet having a minimum size among recording sheets that are capable of being transported on the sheet feed path, the width of the recording sheet having the minimum size extending parallel with the axis of the heating roller.

3. The heating device according to claim 1, wherein the second-level high temperature region formed by the second heater produces a thermal output in a range from 80% to 90% as high as a thermal output of the high temperature region formed by the second heater.

4. The heating device according to claim 1, wherein the low temperature region formed by each of the first and second heaters produces a thermal output in a range from 10% to 40% as high as a thermal output of the high temperature region formed by each of the first and second heaters.

5. The heating device according to claim 1, further comprising a temperature detecting member disposed in opposed relation to an axially central surface of the heating roller for detecting a surface temperature of the heating roller.

6. A heating roller of a fixing device with two internal heaters for axial heat distribution, comprising:

a first heater disposed within the heating roller and having a heat distribution characteristic to form a low temperature region in an axially central portion of the heating roller and a high temperature region in each of axially opposite end portions of the heating roller; and a second heater disposed within the heating roller and having a heat distribution characteristic to form a first-level high temperature region in the axially central portion of the heating roller, a low temperature region in each of the opposite end portions of the heating roller, and a second-level high temperature region in each of axially opposite end portions of the first-level high temperature region, the second-level high temperature region being lower in temperature than the first-level high temperature region and higher in temperature than the low temperature region.

7. The heating roller of a fixing device according to claim 6, wherein the high temperature region formed by the second heater has a width substantially equal to a width of a recording sheet having a minimum size among recording sheets that are capable of being transported on the sheet feed path, the width of the recording sheet having the minimum size extending parallel with the axis of the heating roller.

8. The heating roller of a fixing device according to claim 6, wherein the second-level high temperature region formed by the second heater produces a thermal output in a range from 80% to 90% as high as a thermal output of the high temperature region formed by the second heater.

9. The heating roller of a fixing device according to claim 6, wherein the low temperature region formed by each of the first and second heaters produces a thermal output in a range from 10% to 40% as high as a thermal output of the high temperature region formed by each of the first and second heaters.

10. The heating roller of a fixing device according to claim 6, further comprising a temperature detecting member disposed in opposed relation to an axially central surface of the heating roller for detecting a surface temperature of the heating roller.

* * * * *